US009249632B2

(12) United States Patent
Lakkashetti et al.

(10) Patent No.: US 9,249,632 B2
(45) Date of Patent: Feb. 2, 2016

(54) VIBRATION DAMPER

(71) Applicant: HALLIBURTON ENERGY SERVICES, INC., Houston, TX (US)

(72) Inventors: Malleshappa Lakkashetti, Singapore (SG); Peng Hooi Oon, Singapore (SG)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 14/388,155

(22) PCT Filed: Dec. 4, 2013

(86) PCT No.: PCT/US2013/073150
§ 371 (c)(1),
(2) Date: Sep. 25, 2014

(87) PCT Pub. No.: WO2015/084345
PCT Pub. Date: Jun. 11, 2015

(65) Prior Publication Data

US 2015/0354290 A1 Dec. 10, 2015

(51) Int. Cl.
*E21B 17/10* (2006.01)
*E21B 17/07* (2006.01)

(52) U.S. Cl.
CPC ..... *E21B 17/1014* (2013.01); *E21B 17/07* (2013.01); *E21B 17/1078* (2013.01)

(58) Field of Classification Search
CPC E21B 17/1014; E21B 17/1078; E21B 10/322
USPC ..... 175/269, 267
See application file for complete search history.

(56) References Cited

U.S. PATENT DOCUMENTS

| | | | | |
|---|---|---|---|---|
| 2,743,781 | A | 5/1956 | Lane | |
| 2,880,805 | A | 4/1959 | Nelson et al. | |
| 3,355,939 | A * | 12/1967 | Van Gils | E21B 47/06 73/152.51 |
| 4,471,843 | A | 9/1984 | Jones, Jr. et al. | |

(Continued)

FOREIGN PATENT DOCUMENTS

| | | |
|---|---|---|
| GB | 2270331 | 3/1994 |
| WO | WO 2009/055412 | 4/2009 |
| WO | WO 2009/135248 | 11/2009 |

OTHER PUBLICATIONS

International Search Report and Written Opinion of the International Searching Authority issued in International Application No. PCT/US2013/073150 on Sep. 2, 2014; 11 pages.

*Primary Examiner* — Jennifer H Gay
*Assistant Examiner* — George Gray
(74) *Attorney, Agent, or Firm* — Scott H. Brown; Fish & Richardson P.C.

(57) ABSTRACT

A method includes inserting a vibration damper tool in a drill string, the damper includes a tubular housing having an exterior surface and a longitudinal passageway, and at least one fluid actuated piston assembly. The piston assembly includes an extendable piston, a transverse passageway, a spring chamber in the transverse passageway, and at least one spring disposed in the spring chamber. The spring biases the piston in a refracted position. The drill string and dampening tool are inserted into a wellbore, fluid is flowed down the drill string and exerts pressure on a proximal end of the piston, and creates a fluidic force sufficient to overcome a biasing retractable force of the spring to extend the piston longitudinally until a distal end of the piston contacts a sidewall of the wellbore.

17 Claims, 7 Drawing Sheets

(56) References Cited

U.S. PATENT DOCUMENTS

| | | | | |
|---|---|---|---|---|
| 4,690,229 | A | 9/1987 | Raney | |
| 5,186,264 | A | 2/1993 | du Chaffaut | |
| 6,227,312 | B1 * | 5/2001 | Eppink | E21B 7/064 175/325.1 |
| 6,948,572 | B2 | 9/2005 | Hay et al. | |
| 7,044,219 | B2 | 5/2006 | Mason et al. | |
| 7,523,783 | B2 | 4/2009 | Victor | |
| 8,082,987 | B2 | 12/2011 | Chesnutt | |
| 2005/0098356 | A1 * | 5/2005 | Chau | E21B 7/046 175/321 |
| 2005/0145417 | A1 * | 7/2005 | Radford | E21B 10/322 175/57 |
| 2011/0120772 | A1 | 5/2011 | McLoughlin et al. | |
| 2012/0080231 | A1 * | 4/2012 | Radford | E21B 10/322 175/57 |
| 2012/0168229 | A1 | 7/2012 | Lee | |
| 2012/0228028 | A1 | 9/2012 | Turner et al. | |

* cited by examiner

VIBRATION DAMPER

CLAIM OF PRIORITY

This application is a U.S. National Stage of International Application No. PCT/US2013/073150, filed Dec. 4, 2013.

TECHNICAL FIELD

This disclosure generally relates to a tool and method for damping lateral vibration in a drilling string.

BACKGROUND

In the recovery of hydrocarbons from the earth, wellbores are generally drilled using any of a variety of different methods and equipment selected according to the particular drilling site and objectives. When drilling a well, a drill bit is rotated in axial engagement against the formation to remove rock, to thereby form the wellbore to a desired depth. The drill bit is typically rotated via the rotation of a drill string to which the drill bit is coupled and/or by the rotary force imparted to the drill bit by a subsurface drilling motor.

Downhole vibrations and shocks (referred to collectively and/or interchangeably herein as "shock loads") are induced by interactions between downhole tools and formations along the wellbore. Shock loads induced at points along the drill string are in turn transmitted to other components of the drill string and bottom hole assembly. Lateral shock loads imparted on the drill string can diminish the life of its interconnected members by accelerating the process of fatigue. Lateral shock loads may also cause damage to the wellbore itself, such as when lateral vibrations cause the drill string to contact the walls of the wellbore, for example. Additionally, excessive shock loads can cause spontaneous downhole equipment failure, wash-outs and a decrease in penetration rate.

DETAILED DESCRIPTION

Figure 1:
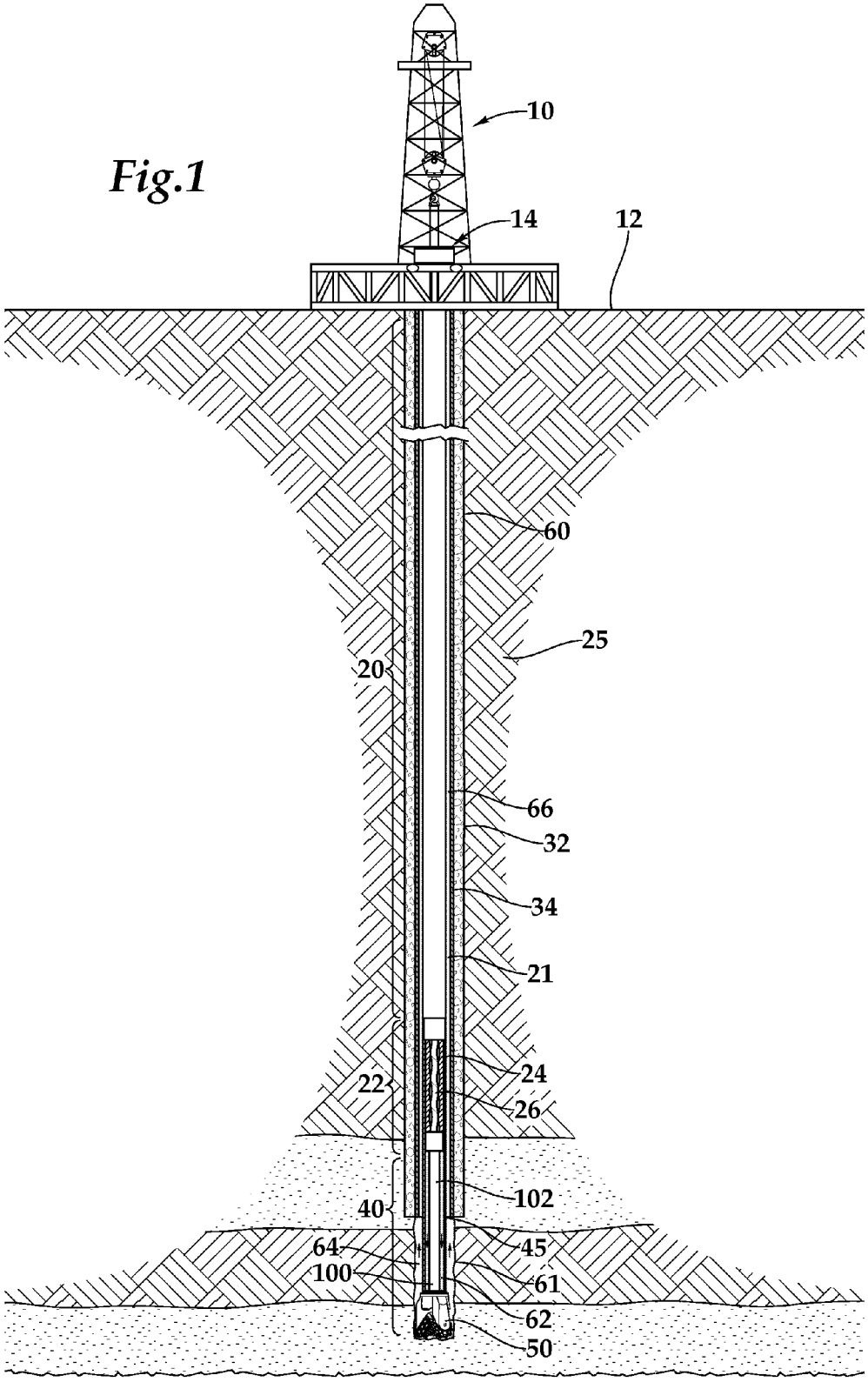
FIG. 1 is a diagram of an example drilling rig for drilling a wellbore.

FIG. 1 is a diagram of an example drilling rig 10 located at a drilling site. A drill string 20 is positioned in a wellbore 60 below a surface 12 at the drilling site. The drill string 20 includes any number of segments of drill pipe 21 interconnected end-to-end to reach a desired drill depth. The surface equipment 14 on the drilling rig 10 is used to drill the wellbore 60 to the desired drill depth by controllably rotating and lowering the drill string 20. The drill string 20 includes a downhole power section 22. The downhole power section 22 may include a positive displacement motor, such as a Moineau type motor having a rotor 26 that is rotatable relative to a stator 24 in response to the controlled delivery of pressurized fluid to the power section 22.

The drill string 20 also includes a "tool string" 40 and a drill bit 50. When the drill string 20 is rotated, power and torque are transferred to the drill bit 50 and other downhole equipment coupled to a lower end of the drill string 20, such as to the "tool string" 40 attached to a longitudinal output shaft 45 of a downhole positive displacement motor. The drill bit 50 may alternatively rotated by the downhole positive displacement motor when the drill string 20 is not being rotated from the surface 12.

After drilling the wellbore 60, the wellbore 60 may be reinforced by a cementing operation with a casing 34 and a cement sheath 32 in the annulus between the casing 34 and the borehole.

During drilling, the surface equipment 14 pumps drilling fluid (i.e. drilling mud) 62, down the drill string 20 and out ports in the bit 50. The drilling mud then flows up the annulus 64 between the drill string and borehole wall. The surface equipment rotates the drill string 20, which in the implementations shown is coupled to the stator 24 of the downhole motor in the power section. The rotor 26 is rotated due to pumped fluid 62 pressure differences across the power section 22 relative to the stator 24 of a downhole positive displacement motor.

While drilling, the tool string 40 and/or the drill bit 50 may transmit vibrations that can travel along the drill string 20. For example, the drill pipe 21 may flex and contact the wellbore 60 or a wellbore wall 61, sending vibrations along drill string 20. A vibration damper assembly 100 is included along the tool string 40 to reduce the amount of vibration that is propagated along the tool string 40.

Figure 2A:
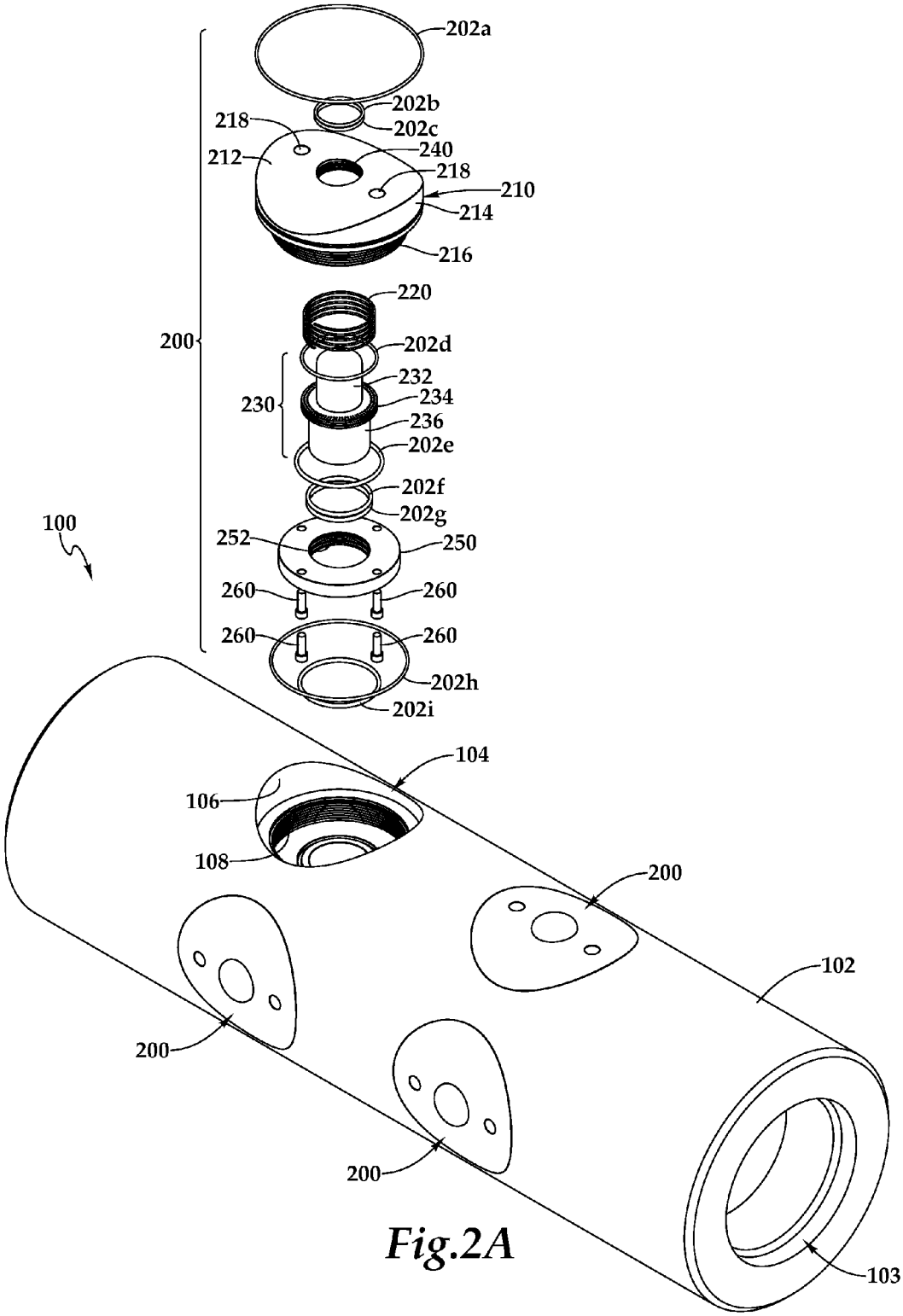
FIG. 2A is a perspective exploded view of an example vibration damper assembly.

FIG. 2A is a perspective exploded view of the example vibration damper assembly 100. The vibration damper assembly 100 includes a collection of piston assemblies 200 arranged about the axial length and about the outer circumference of the generally cylindrical body of a tubular housing 102. The tubular housing 102 has a longitudinal passageway 103 including several bore sections. Each of the piston assemblies 200 occupies a corresponding transverse passageway 104 formed in the tubular housing 102 and extending radially from the longitudinal passageway 103. Each of the transverse passageways 104 includes a smooth bore section 106 and a threaded bore section 108.

Figure 2B:
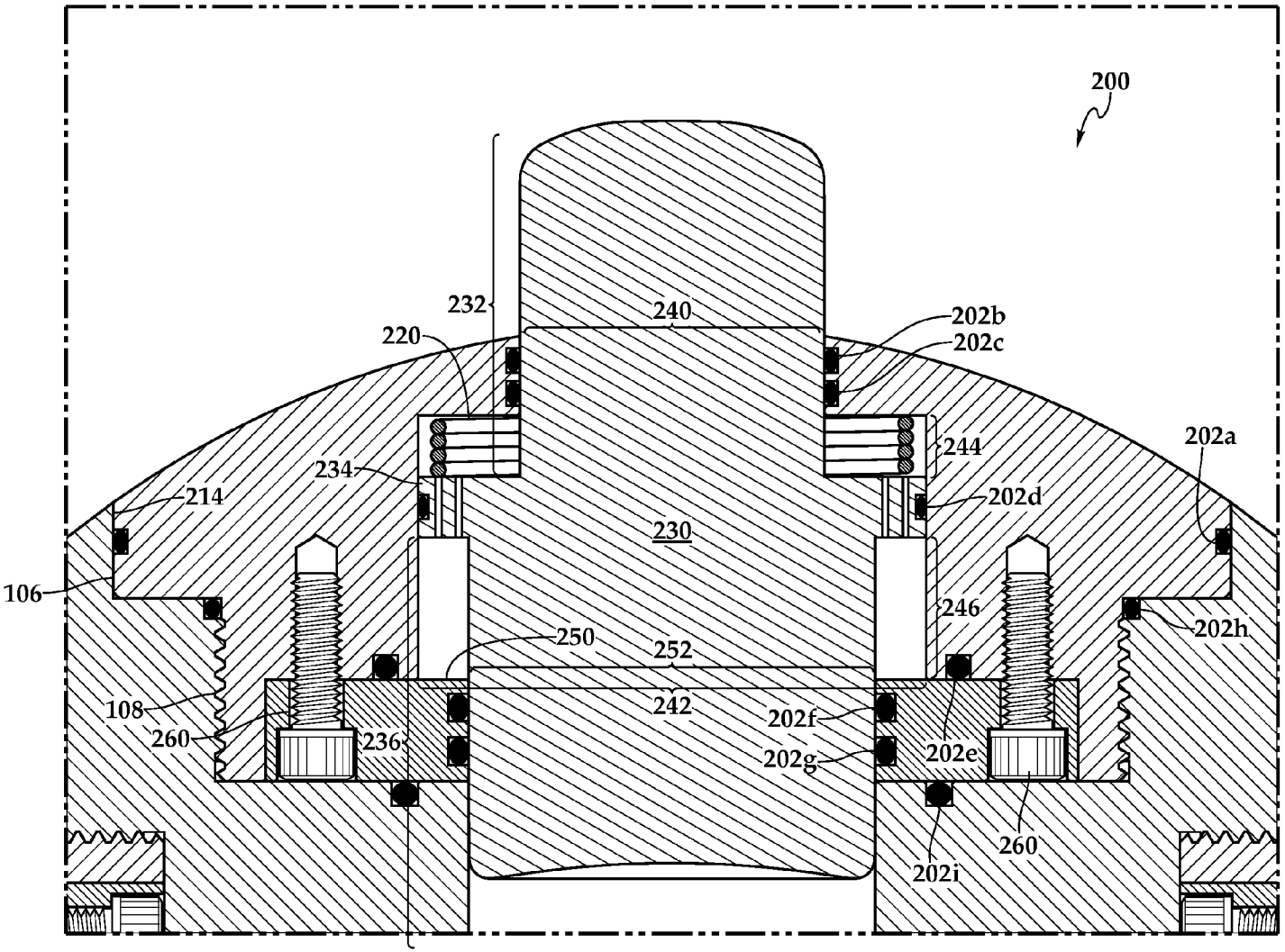
FIG. 2B is a cross sectional view of the example vibration damper piston assembly of FIG. 1A.

The piston assembly 200 will now be described, referring to both the exploded view provided by FIG. 2A and the view provided by FIG. 2B, which is a cross sectional view of the example piston assembly 200. Each of the piston assemblies 200 includes a collection of seals 202*a*-202*i*. In some embodiments, the seals 202*a*-202*i* can be O-rings, D-rings, square seals, or combinations of these or other appropriate seal types.

A piston cap 210 is formed with an outer surface 212, an outer peripheral surface 214, and a threaded section 216. The outer surface 212 is semi-cylindrical in shape, with a radius and curvature that approximates that of the tubular housing 102. The outer peripheral surface 214 is formed with a diameter that substantially fills the smooth bore section 106 of a corresponding one of the transverse passageways 104. The outer periphery of the threaded section 216 is formed with circumferential threads that threadably mate with threads formed upon the inner circumference of the threaded bore section 108 of the corresponding one of the transverse passageways 104. A pair of spanner holes 218 is formed in the outer surface 212. In some implementations, the spanner holes 218 can accept the pins of a spanner wrench to assist in the assembly and disassembly of the transverse passageway 210 with the tubular housing 102.

A spring 220 is located about an upper section 232 of a damper piston 230. The upper section 232 is a generally cylindrical body that is formed to pass through an upper bore portion 240 formed radially through the piston cap 210. The upper section 232 is separated from a lower section 236 of the damper piston 230 by a circumferential ring 234. The circumferential ring 234 is formed about the outer periphery of the damper piston 230. The circumferential ring 234 has a diameter that substantially fills a lower bore portion 242 of the piston cap 210. The lower bore portion 242 is radially larger than and along the same axis as the upper bore portion 240 through the housing cap 210. The lower bore portion 242 has a diameter sized to slidably receive the circumferential ring 234. The lower bore portion 242 is formed partly through a radial section of the piston cap 210 opposite the outer surface 212.

The spring 220 rests against the circumferential ring 234 and becomes constrained axially about the upper section 232 within a spring chamber 244. The spring chamber 244 is defined between the circumferential ring 234 and the piston cap 210 and the lower bore portion 242 in the assembled form of the piston assembly 200. A fluid reservoir 246 is defined by the opposite side of the circumferential ring 234, the lower bore portion 242, and a support plate 250. The support plate 250 is formed as a disk with an outer diameter larger than that of the lower bore portion 242, and a central bore 252 formed to accommodate the lower section 236. The support plate 250 is removable, fastened to the piston cap 210 by a collection of fasteners 260, e.g., bolts, screws.

Figure 3A:
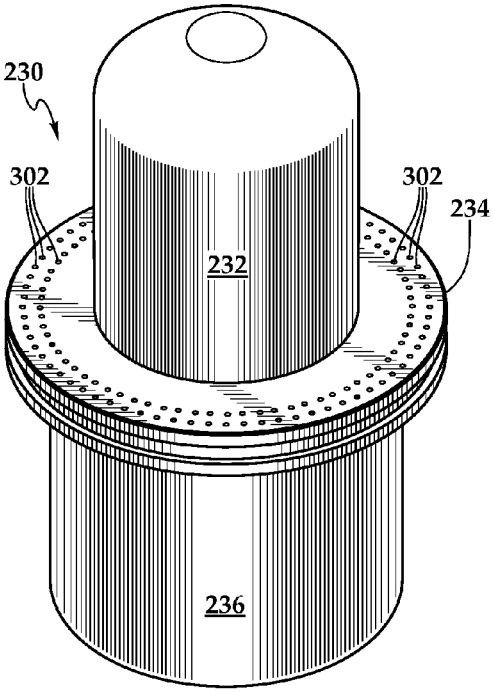
FIGS. 3A-3D are various views of an example piston assembly used in the vibration damper assembly of FIG. 2A.
Figure 3D:
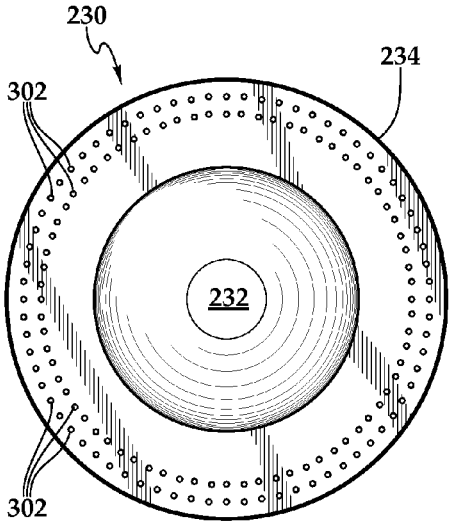
Figure 3C:
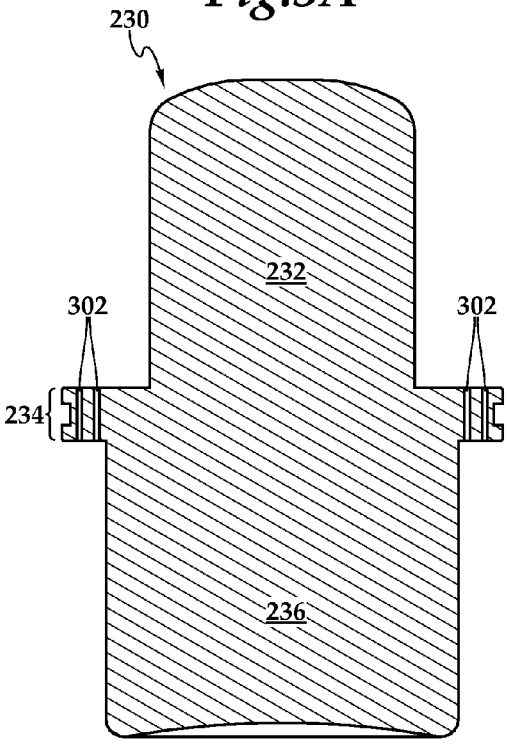
Figure 3B:
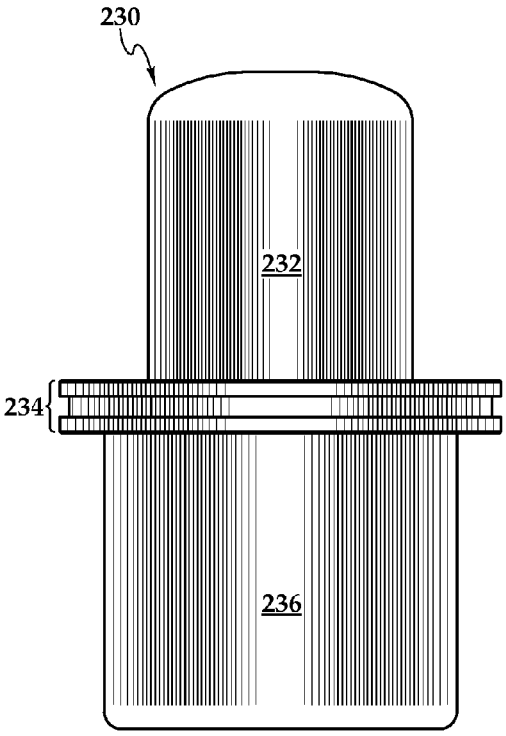

FIGS. 3A-3D are a perspective view, side view, cross section side view, and end view of the example damper piston 230 of FIG. 2A. Visible in these views are the upper section 232, the circumferential ring 234, and the lower section 236. Also visible in FIGS. 3A, 3C, and 3D are a collection of apertures 302. With particular reference to FIG. 3C, the apertures 302 are axial bores formed through the circumferential ring 234. In the assembled form of the vibration damper 100, the apertures fluidly connect the spring chamber 244 of FIG. 2A with the fluid reservoir 246.

Figure 4A:
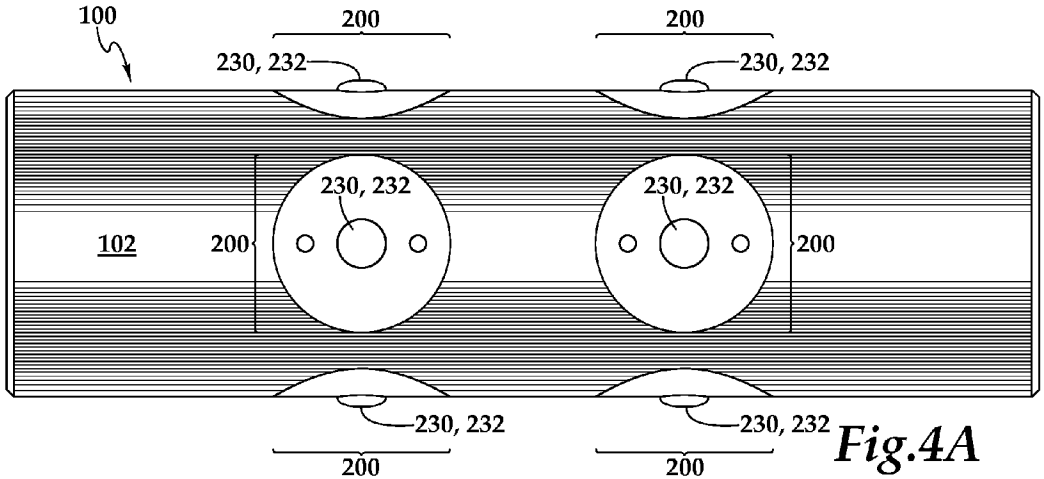
FIGS. 4A-4D are various views of the example vibration damper assembly with a collection of damper pistons in a retracted configuration.
Figure 4B:
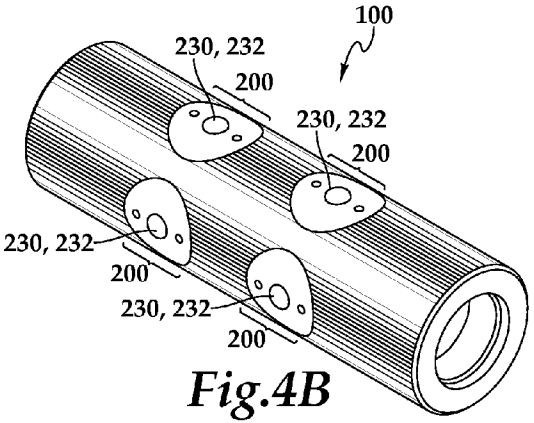
Figure 4C:
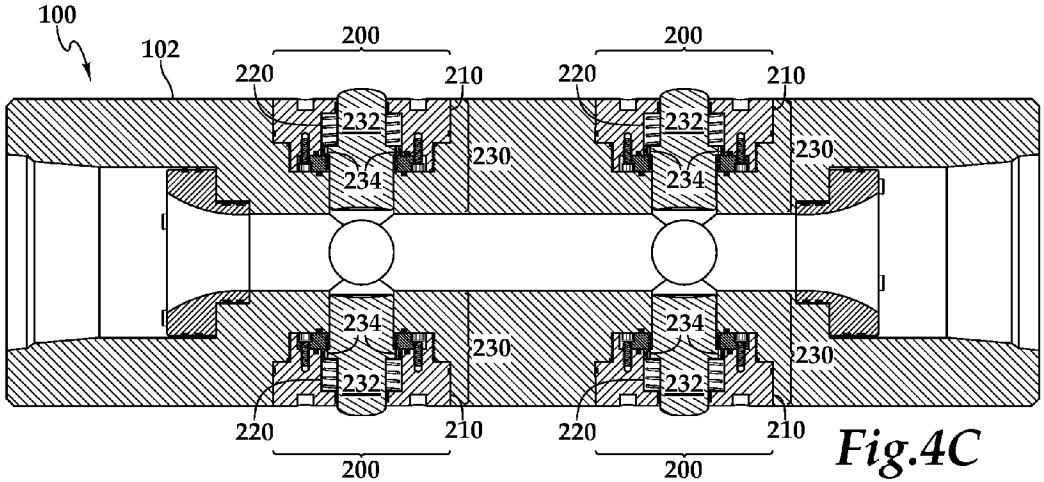
Figure 4D:
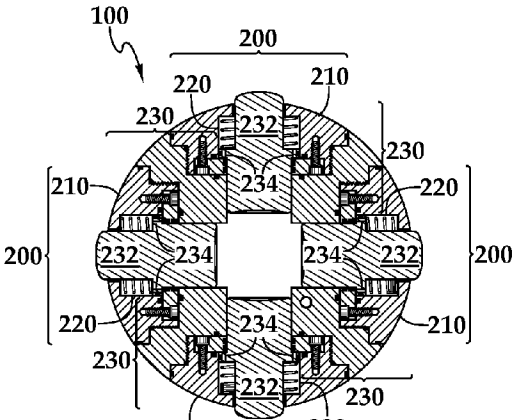

FIGS. 4A-4D are a side view, perspective view, side cross section view, and end cross section view of the example vibration damper assembly 100 with a collection of the damper pistons 230 in a retracted configuration. The damper pistons 230 are considered to be retracted when their respective upper sections 236 do not protrude substantially beyond the outer periphery of the tubular housing 102. With reference to FIGS. 4C and 4D, each damper piston 230 is urged into its retracted configuration by the spring 220 exerting a spring force against the transverse passageway 210 and the circumferential ring 234.

FIGS. 5A-5D are a side view, perspective view, side cross section view, and end cross section view of the example vibration damper assembly 100 with a collection of the damper pistons 230 in an extended configuration. The damper pistons 230 are considered to be extended when their respective upper sections 236 protrude substantially beyond the outer periphery of the tubular housing 102 by a radial distance 502.

Figure 5B:
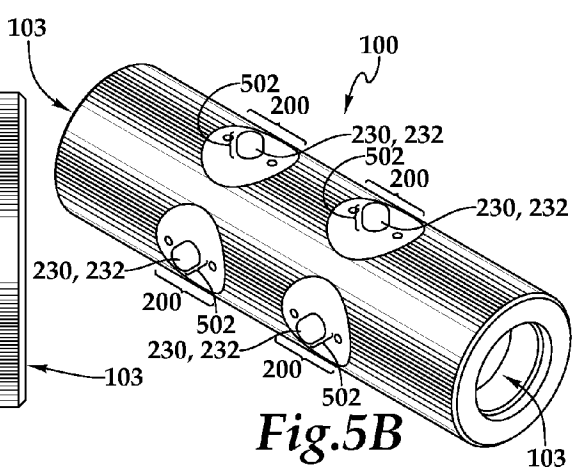
FIGS. 5A-5D are various views of the example vibration damper assembly with a collection of damper pistons in an extended configuration.
Figure 5A:
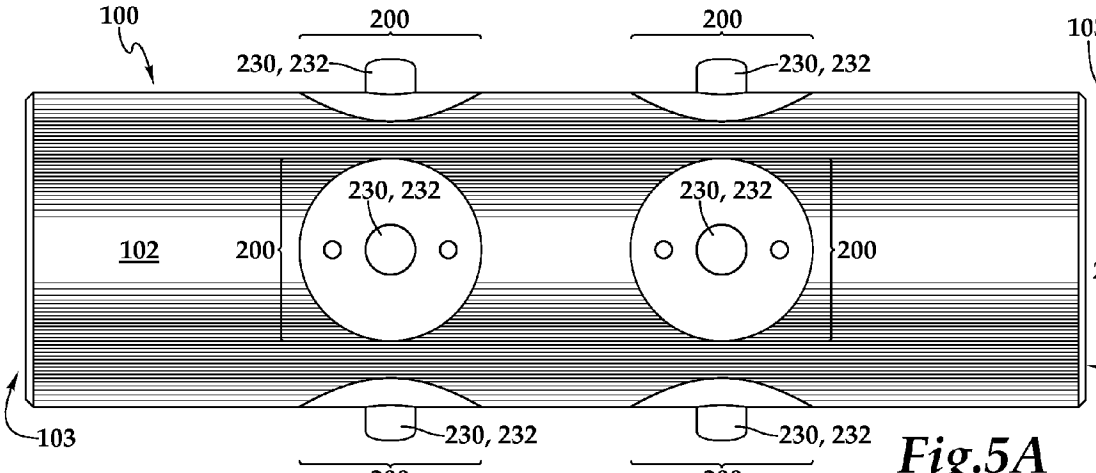
Figure 5D:
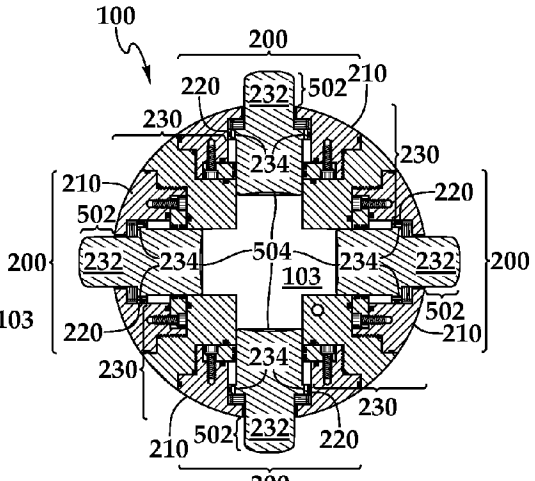
Figure 5C:
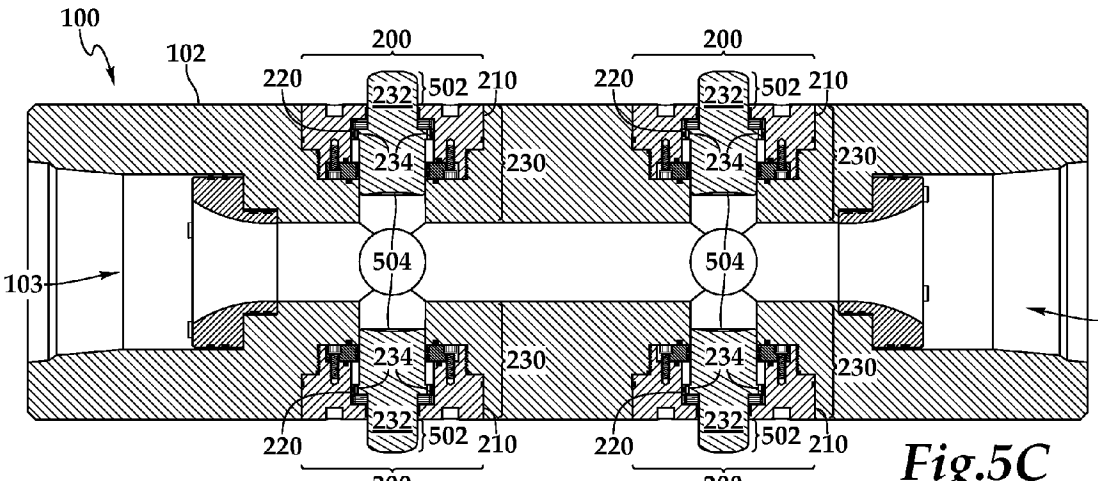

With reference to FIGS. 5C and 5D, each damper piston 230 is urged into its extended configuration by applying a pressurized fluid, such as drilling fluid, within the bore 103. The fluid exerts a fluid pressure upon a lower surface 504 of the lower section 236 of the damper piston 230. When a predetermined amount of fluidic force is provided, the biasing retractable force of the spring 220 is overcome and urges the upper portion 232 to protrude beyond the outer periphery of the tubular housing 102.

Extension and retraction of the upper portion 232 of the damper piston 230 is damped by fluidic action. Referring back to FIG. 2B, a fluid such as hydraulic oil substantially fills the spring chamber 244 and the fluid reservoir 246. As the damper piston 230 is urged from the retracted position to the extended position, fluid in the spring chamber 244 is displaced through the collection of apertures 302 to the fluid reservoir 246. The apertures 302 restrict the flow of the fluid from the spring chamber 244 to the fluid reservoir 246, resisting the extensile movement of the damper piston 230. Similarly, as the damper piston 230 is urged from the extended position to the retracted position, e.g. when the upper portion 232 contacts the wellbore wall 61, hydraulic fluid in the fluid reservoir 246 is displaced through the collection of apertures 302 to the spring chamber 244. The apertures 302 restrict the flow of the fluid from the fluid reservoir 246 to the spring chamber 244, compliantly resisting the retraction of the damper piston 230.

This resistance that is developed by the flow of fluid through the apertures 302 dampens the speed of the damper piston 230 in response to changes in the pressure of fluids provided within the bore 103 and/or to external forces acting upon the upper portion 232, e.g. when the upper portion 232 contacts the wellbore 60. In some embodiments, the apertures 302 can be configured to provide a predetermined amount of damping. For example, the quantity and/or bore sizes of the apertures 302 can be selected to provide various damping rates. In another example, check valves or other directional flow assemblies can be included in the damper piston 230 to provide a first damping rate during extension and a different damping rate during retraction of the upper portion 232. In yet another example, other appropriate assemblies may be included in the damper piston 230 to provide speed-dependent, e.g., progressive, damping rates during extension or retraction of the upper portion 232.

Figures 6A, 6B, 6C:
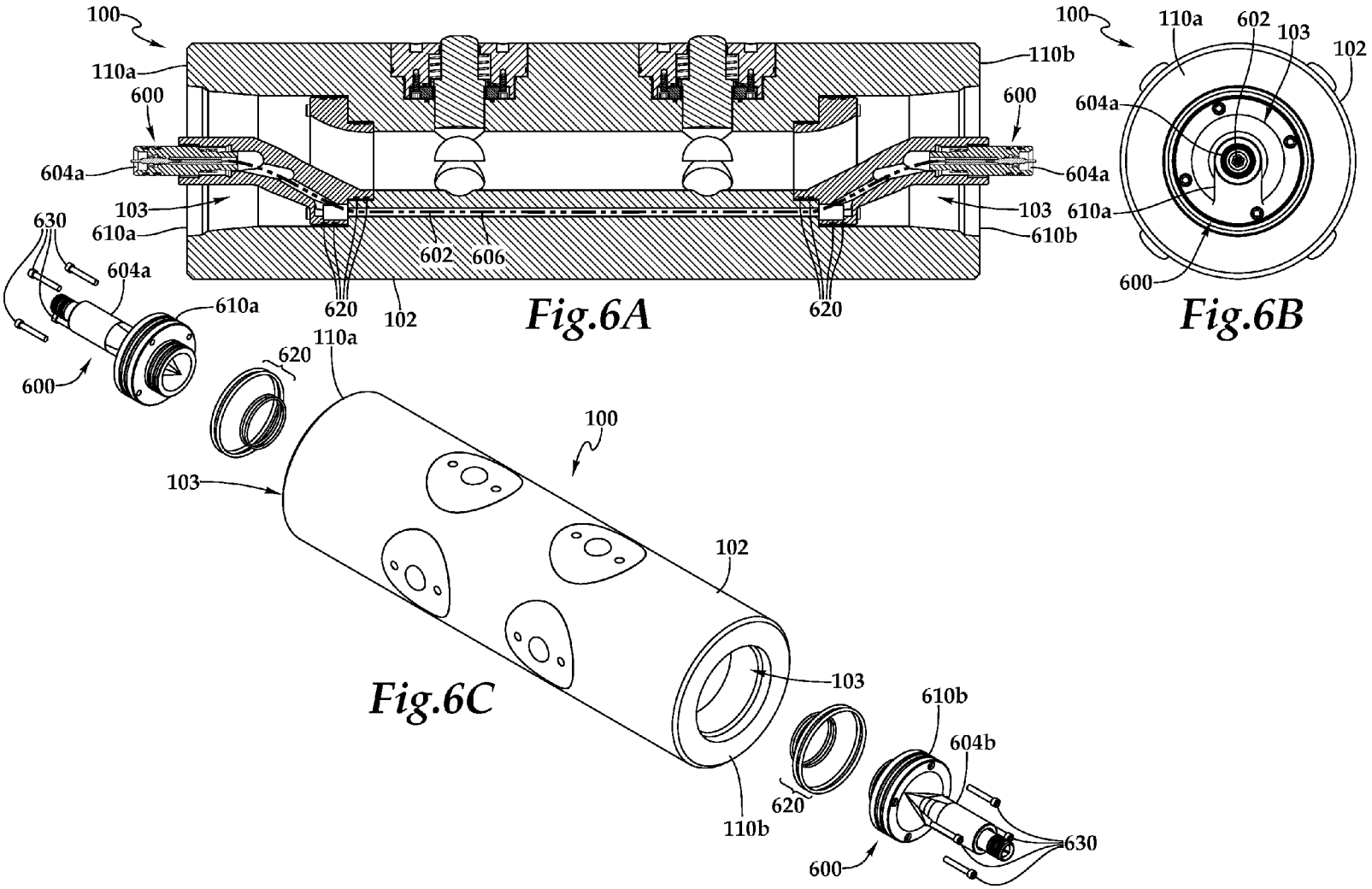
FIGS. 6A-6C are various views of an example vibration damper assembly with an electrical interface assembly.

FIGS. 6A-6C are cross sectional, end, and exploded perspective views of the example vibration damper assembly 100 with an electrical interface assembly 600. In general, the electrical interface assembly 600 provides one or more electrically conductive pathways to transmit power and/or electrical signals from one end of the assembly 100 to the other. For example, the electrical interface assembly 600 can be used to provide power and/or communications between equipment at the surface 12 and measuring while drilling (MWD) or logging while drilling (LWD) tools positioned below the damper assembly 100.

The electrical interface assembly 600 includes one or more electrical conductors 602. The electrical conductors 602 extend from an electrical connector 604*a* located at a first end 110*a* of the assembly 100 to an electrical connector 604*b* located at a second end 110*b* of the assembly 100. The electrical conductors 602 are routed through a conduit 606. In some embodiments, the conduit 606 can be electrically and/or mechanically isolated from the bore 103. For example, the conduit 606 may be electrically insulating, and/or protect the electrical conductors 602 from fluids within the bore 103.

The electrical connector 604*a* is supported by a bracket 610*a*, and the electrical connector 604*b* is supported by a bracket 610*b*. The brackets 610*a*, 610*b* position and orient the electrical connectors 604*a*, 604*b* relative to the tubular housing 102. For example, the brackets 610*a*, 610*b* can align the electrical connectors 604*a*, 604*b* with the central axis of the vibration damper assembly 100, and electrical contact can be made between the electrical connectors 604*a*, 604*b* and similar electrical connectors in adjacent tool string components when the adjacent tool string components are threaded into the vibration damper assembly 100.

A collection of seals 620 provide sealing contact between the tubular housing 102 and the brackets 604*a*, 604*b*. A collection of fasteners 630, such as bolts or screws, removably secures the bracket 604*a* to the first end 110*a* and the bracket 604*b* to the second end 110*b*.

While drilling, a vibration damper assembly 100 is inserted in the drill string 20. A first end portion of the spring 220 is contacted with at least a portion of the spring chamber 244 and a second end portion of the spring 220 is contacted with the circumferential ring 234, biasing the damper piston 230 in a retracted position such as the position shown in FIGS. 4A-4D. The drill string 20 and vibration damper assembly 100 are inserted into the wellbore 60. The fluid 62 is flowed down the drill string 20 and exerts fluid pressure on the lower surface 504 of the lower portion 236 of the damper piston 230. The fluidic pressure acting on the lower surface 504 creates a fluidic force sufficient to overcome a biasing retractable force of the spring 220. The fluidic force extends the damper piston 230 longitudinally until the upper portion 232 contacts the wellbore wall 61.

Although a few implementations have been described in detail above, other modifications are possible. For example, the process flows described herein do not require the particular order shown, or sequential order, to achieve desirable results. In addition, other steps may be provided, or steps may be eliminated, from the described flows, and other components may be added to, or removed from, the described systems. Accordingly, other implementations are within the scope of the following claims.

What is claimed is:

1. A vibration damper tool for a down hole drill string, said damper tool comprising:

a tubular housing connectable at each end to components of a drill string, said tubular housing having an exterior surface on an exterior wall, a longitudinal passageway, and a transverse passageway extending radially away from the longitudinal passageway in the tubular housing;

at least one fluid actuated piston assembly, said piston assembly including:

a piston positioned in the transverse passageway extending radially away from the longitudinal passageway in the tubular housing, said piston having:

a piston body with a longitudinal axis and a distal end and a distal portion, said distal portion positioned in an opening through the exterior wall of the tubular housing and a proximal end and a proximal portion, said proximal portion in fluidic connection with the longitudinal passageway of the tubular housing, and a circumferential ring disposed perpendicular to the longitudinal axis and around the piston body between the distal end and the proximal end, said ring having a maximum outer diameter greater than a maximum outer diameter of the distal portion of the piston and a maximum outer diameter of the proximal portion, and the maximum outer diameter of the proximal portion being greater than the maximum diameter of the distal portion, and said ring having a first lateral face perpendicular to the longitudinal axis and a second lateral face perpendicular to the longitudinal axis; and a piston cap removably positioned in a distal end of the transverse passageway, said piston cap having a bore having a first portion disposed distally away from the longitudinal passageway, said first portion of the piston cap bore having a diameter sized to receive the distal end portion of the piston and allow at least a portion of the distal portion of the piston to pass therethrough, and a second portion of the bore of the piston cap disposed proximally toward the longitudinal passageway, said second portion of the piston cap bore having a diameter sized to receive the proximal portion of the piston;

a spring chamber defined by the second portion of the piston cap bore and at least a portion of the distal portion of the piston and the first lateral face of the circumferential ring; and at least one spring disposed in the spring chamber wherein a first end of the spring contacts the first lateral face of the circumferential ring and a second end of the spring contacts at least a portion of the spring chamber.

2. The damper tool of claim 1 wherein the circumferential ring is formed integral with the body of the piston.

3. The damper tool of any of claim 1 wherein the spring is disposed around the distal portion of the piston.

4. The damper tool of claim 3 wherein the circumferential ring includes a plurality of apertures extending from the first lateral face of the circumferential ring to the second lateral face of the circumferential ring.

5. The damper tool of claim 4 wherein hydraulic oil is provided in the spring chamber and is fluidically connected via the apertures of the circumferential ring to a hydraulic oil reservoir defined in the transverse passageway.

6. The damper tool of claim 1 wherein a plurality of piston assemblies is positioned in the damper tool.

7. The damper tool of claim 6 wherein the plurality of piston assemblies are located in opposing pairs spaced circumferentially around the tubular housing.

8. The damper tool of claim 1, further comprising a first electrical connector at a first end of the tubular housing, the first electrical connector being conductively connected to a second electrical connector at a second end of the tubular housing by an electrically conductive conduit within the longitudinal passageway.

9. The damper tool of claim 8, further comprising a first bracket at the first end and a second bracket at the second end, wherein the first bracket supports the first electrical connector at an axis of the longitudinal passageway, and the second bracket supports the second electrical connector at the axis.

10. The damper tool of claim 1 wherein the circumferential ring includes a plurality of apertures extending from the first lateral face of the circumferential ring to the second lateral face of the circumferential ring.

11. A method of damping vibration in a drill string located in a wellbore, said method comprising:

inserting a vibration damper tool in a drill string, the damper tool comprising:

a tubular housing connectable at each end to components of a drill string, said tubular housing having an exterior surface on an exterior wall, a longitudinal passageway and a transverse passageway extending radially away from the longitudinal passageway in the tubular housing, at least one fluid actuated piston assembly, said piston assembly comprising;

a piston positioned in the transverse passageway extending radially from the longitudinal passageway in the tubular housing, said piston comprising a piston body with a longitudinal axis and a distal end and a distal portion, said distal portion positioned in an opening through the exterior wall of the tubular housing and a proximal end and a proximal portion, said proximal portion in fluidic connection with fluid in the longitudinal passageway of the tubular housing, and a circumferential ring disposed perpendicularly to the longitudinal axis and around the piston body between the distal end and proximal end, said ring having a maximum outer diameter greater than a maximum outer diameter of the distal portion of the piston and a maximum outer diameter of the proximal portion, and the maximum outer diameter of the proximal portion being greater than the maximum outer diameter of the distal portion, and said ring having a first lateral face perpendicular to the longitudinal axis and a second lateral face perpendicular to the longitudinal axis;

a piston cap removably positioned in a distal end of the transverse passageway, said piston cap having a bore having a first portion disposed distally away from the longitudinal passageway, said first portion of the piston cap bore having a diameter sized to receive the distal end portion of the piston and allow at least a portion of the distal portion of the piston to pass therethrough, and a second portion of the bore of the piston cap disposed proximally toward the longitudinal passageway, said second portion of the piston cap bore having a diameter sized to receive the proximal portion of the piston; and a spring chamber defined by the second portion of the bore of the piston cap and at least a portion of the distal portion of the piston and the first lateral face of the circumferential ring, and at least one spring disposed in the spring chamber;

contacting a first end of the spring with at least a portion of the spring chamber and a second end of the spring with the first lateral face of the circumferential ring and biasing the piston in a retracted position;

inserting the drill string and dampening tool into a wellbore;

flowing fluid down the drill string and a exerting fluid pressure on a surface of the proximal end of the piston, said fluid pressure acting on a surface of the proximal end of the piston creating a force sufficient to overcome a biasing retractable force of the spring; and extending the piston longitudinally away from the longitudinal passageway until the distal end contacts a sidewall of the wellbore.

12. The method of claim 11 wherein the damper tool further comprises a first electrical connector at a first at a first end of the tubular housing, the first electrical connector being conductively connected to a second electrical connector at a second end of the tubular housing by an electrically conductive conduit within the longitudinal passageway, the method further comprising passing electrical power and/or electrical signals from the first electrical connector to the second electrical connector through the electrically conductive conduit.

13. The method of claim 11 wherein the circumferential ring is formed integral with the body of the piston.

14. The method of claim 11 wherein the spring is disposed around the distal portion of the piston.

15. The method of claim 11 wherein the circumferential ring includes a plurality of apertures extending from the first lateral face of the circumferential ring to the second lateral face of the circumferential ring, the method further comprising:

providing hydraulic oil in the spring chamber; and fluidically connecting the spring chamber to a hydraulic oil reservoir via the apertures of the circumferential ring.

16. The method of claim 15, further comprising:

flowing the hydraulic oil from the spring chamber through the apertures to the hydraulic oil reservoir; and damping movement of the piston by controlling a rate of flow of the hydraulic oil through the apertures.

17. The method of claim 16, further comprising:

contacting the distal end with the sidewall of the wellbore with a return force sufficient to overcome the force extending the piston and exerting a return force on the circumferential ring;

retracting the piston longitudinally with the return force;

flowing the hydraulic oil from the hydraulic oil reservoir through the apertures to the spring chamber; and damping a rate of speed at which the piston is retracted, based on the rate of flow of the hydraulic oil through the apertures.

* * * * *

UNITED STATES PATENT AND TRADEMARK OFFICE

CERTIFICATE OF CORRECTION

PATENT NO. : 9,249,632 B2
APPLICATION NO. : 14/388155
DATED : February 2, 2016
INVENTOR(S) : Malleshappa Lakkashetti and Peng Hooi Oon It is certified that error appears in the above-identified patent and that said Letters Patent is hereby corrected as shown below:

In the Claims:

Column 6, line 25, in Claim 3, after "tool of" delete "any of".

Column 8, line 10, in Claim 12, after "connector" delete "at a first".

Signed and Sealed this
Third Day of May, 2016

Michelle K. Lee

Michelle K. Lee
*Director of the United States Patent and Trademark Office*